United States Patent [19]

Hirano et al.

[11] 4,315,186

[45] Feb. 9, 1982

[54] REFLECTIVE LAMP

[75] Inventors: Tomiyoshi Hirano; Hidehiro Shinada, both of Yokohama; Michiyuki Sawada, Yokosuka, all of Japan

[73] Assignee: Tokyo Shibaura Denki Kabushiki Kaisha, Kawasaki, Japan

[21] Appl. No.: 52,211

[22] Filed: Jun. 26, 1979

[30] Foreign Application Priority Data

Jul. 3, 1978 [JP] Japan ..... 53-80755

[51] Int. Cl.[3] ..... H01K 1/26

[52] U.S. Cl. ..... 313/111; 313/112; 313/113

[58] Field of Search ..... 313/112, 113, 114, 110, 313/111

[56] References Cited

U.S. PATENT DOCUMENTS 3,662,208 5/1972 Ohmae et al. ..... 313/111 X 4,127,789 11/1978 Kostlin et al. ..... 313/112

*Primary Examiner*—Palmer C. Demeo

*Assistant Examiner*—Darwin R. Hostetter

*Attorney, Agent, or Firm*—Cushman, Darby & Cushman

[57] ABSTRACT

Provided is a reflective lamp comprising a bulb including a front lens section and a reflective mirror section fused thereto, said front lens section consisting of glass material containing neodymium and coated on its inner surface with a first thin film reflecting infrared rays and permitting visible lights to be transmitted therethrough, said reflective mirror section consisting of glass material containing no neodymium and coated on its inner surface with a second thin film reflecting visible lights. The lamp is capable of preventing the rise in the temperature of the bulb and yet providing a sufficiently high color rendering. Further, the lamp can offer the advantage of reducing its manufacturing cost.

7 Claims, 1 Drawing Figure

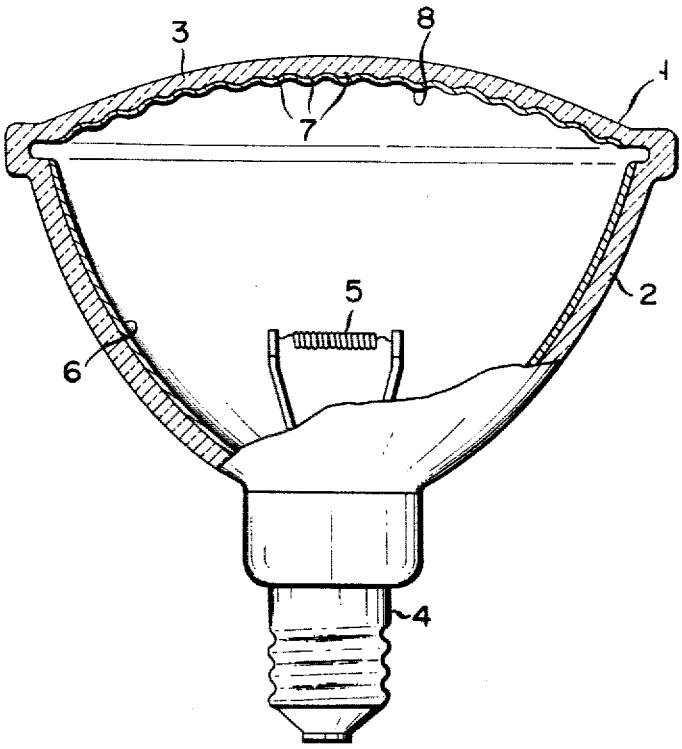
3
8
1
7
5
2
6
4

REFLECTIVE LAMP

BACKGROUND OF THE INVENTION

This invention relates to a reflective electric lamp, and more particularly to a reflective electric lamp of shield beam type, which is capable of effecting high color rendering.

Conventionally, wide use was made of incandescent and fluorescent lamps as light sources for general illumination. These light sources, however, were not satisfactory as those required to effect high color rendering as in the case of, for example, a light source for illumination of a show window. For example, the fluorescent lamp has the drawback that its warm color and the like are rendered weak although its white color, cold color and the like are rendered intensive. Therefore, attempts have been made to eliminate such drawback of the fluorescent lamp by improving, for example, the compositions of the phosphor. A satisfactory result, however, has not yet been obtained. Further, the incandescent lamp has the drawback that, since it emits yellowish light components, its whitish color is rendered weak. For the purpose of removing such drawback is practically used an incandescent lamp having a bulb formed of glass material containing neodymium. The glass material containing neodymium selectively absorbs lights having a wavelength 580 nm and around 580 nm, i.e., yellowish lights. If, therefore, the bulb of an incandescent lamp is formed of such glass material, it will absorb yellowish lights numerously contained in the lights emitted from the incandescent lamp. Accordingly, all colors of articles illuminated by the lights emitted from the lamp, including warm colors, cold colors, whitish colors, etc., look very clear. This means that such incandescent lamp indicates a high color rendering. The incandescent lamp, therefore, suits illuminating fresh foods such as fish, meats, and vegetables and colorful cloths.

The glass material containing neodymium, however, has the property of absorbing not only the above-mentioned yellowish lights but also the lights whose wavelengths fall on and within the area near the border of wavelength between red and near infrared lights. The bulb formed of such glass material, therefore, is inconveniently more allowed to heat than a bulb formed of usual glass material. Particularly, the lamp for illumination of fresh foods is required to make the freshness of the foods inpressive. This means that a high intensity of illumination is demanded of such lamp. This results in a large light flux of the bulb per unit area. This causes an excessive increase in the temperature of the bulb to cause evolution of gases from it. This shortens the life of the bulb. In order to prevent such increase in the bulb temperature, limitation must be imposed upon the containing amount of neodymium. This, however, becomes a barrier in achieving a high color rendering. Further, neodymium is nowadays very expensive and the lamp using glass material containing such expensive neodymium is also expensive. This is a barrier in making the use of such lamp wider.

SUMMARY OF THE INVENTION

The object of the invention is to provide a reflective lamp which prevents the excessive rise in the temperature of the bulb and yet provides a sufficient color rendering and which can be reduced in the manufacturing cost.

According to the invention, there is provided a reflective lamp which comprises a bulb including a front lens section and a reflective mirror section fused thereto, said front lens section consisting of glass material containing neodymium and coated on its inner surface with a first thin film reflecting infrared rays and permitting visible lights to be transmitted therethrough, said reflective mirror section consisting of glass material containing no neodymium and coated on its inner surface with a second thin film reflecting visible lights.

BRIEF DESCRIPTION OF THE DRAWINGS

The drawing is a sectional view of a reflective lamp according to an embodiment of the invention.

DETAILED DESCRIPTION OF THE PREFERRED EMBODIMENT

A reflective lamp according to an embodiment of the invention will now be described by reference to the appended drawing.

In the drawing, a bulb 1 comprises a funnel-shaped reflective mirror section 2 and a front lens section 3, the section 2 being hermetically fused to the section 3 at their peripheral edge portions. A lamp base 4 is fitted to a neck portion of the reflective mirror section 2. Within the bulb 1 a filament 5 is provided and inert gas such as Argon is sealed.

The reflective mirror section 2 is formed by press-molding a usual glass material containing no particular substance, such as borosilicate glass. The inner surface of the reflective mirror section 2 is for example, ellipsoidal and is coated with a so-called cold mirror film 6 reflecting visible lights and permitting infrared rays to be transmitted therethrough. The film 6 can be formed into a multi-layer interference film which consists, for example, of four layers of $MgF_2$-Ge-$MgF_2$-$TiO_2$. The front lens section 3 is formed of glass material containing neodymium, for example, borosilicate glass containing usual components such as $SiO_2$, $B_2O_3$, etc. and neodymium oxide ($Nd_2O_3$). The amount of $Nd_2O_3$ contained in the borosilicate glass accounts for 0.5 to 5.0% by weight, or more preferably accounts for 1.0 to 2.5% by weight, based upon the total weight of the glass material. The neodymium has the propensity of selectively absorbing the yellowish lights whose wavelengths fall on and within the area near 580 nm and also the lights whose wavelenghts fall on and within the area near the border of wavelength between red and near infrared lights. The front lens section 3, similarly to the reflective mirror section 2, is of the press-molded type and has its inner surface formed with a number of semi-spherical projections 7 for diffusing the lights transmitting the section 3. The inner surface of the front lens section 3 is coated with a thin film 8 permitting transmission of visible lights therethrough and reflecting infrared rays. The film 8 can be a so-called EC coating film, for example, a thin film prepared by adding minute amounts of Sb, Sn, etc. to a halide of metal such as Sn, In or the like. The fused portion between the section 3 and the section 2 has sufficiently removed a residual stress produced at the time of fusing both sections to each other.

According to the reflective lamp having the foregoing structure, when the lights emitted from the filament 5 pass through the front lens section 3, those of such lights which have the wavelengths falling on and under the area near 580 nm are absorbed by the section 3. This results in a relative increase in bluish, greenish and redish ones of the lights emitted from the reflective lamp. The lamp of the invention, therefore, makes such bluish, greenish and redish lights impressive. This means that it can provide a high color rendering. Further, a large number of infrared rays are emitted from the filament 5. These rays are partially transmitted through the cold mirror film 6 and are ejected outside or rearwardly. Those rays are partially reflected by the cold mirror film 6. The infrared rays emitted from the filament 5 directly to the front lens section 3 and the infrared rays reflected by the cold mirror film 6 are for the most part reflected by the thin film 8 coated on the inner surface of the front lens section 3 and are allowed to impinge upon the cold mirror film 6 to pass through it, whereby they are ejected outside or rearwardly. In this way, the amount of infrared rays which are absorbed into the front lens section 3 or allowed to pass through it largely decreases. This causes reduction in the rise of the temperature of the front lens section 3 attributed to its absorption of the infrared rays. Further, since a large number of projections for diffusion of the lights are provided on the inner surface of the front lens section 3, the lights passing through the section 3 become diffused lights. This prevent an image of the filament 5 from being projected onto the plane illuminated.

The amount of neodymium contained in the glass material constituting the front lens section 3 is preferably in the range of 0.5 to 5.0% by weight as calculated in terms of $Nd_2O_3$.

The reasons are as follows. In the case of less than 0.5% by weight the absorption of yellowish lights into the section 3 is insufficient with a result that we fail to obtain a desired effect which can be expected from causing neodymium to be contained in the glass material. Further, in the case of more than 5.0% by weight, the absorption of yellowish lights is excessive, so that the other colors such as red become too impressive and the lamp has unnatural colors as a whole. Further, in the case of more than 5.0% by weight, the difference in thermal expansion coefficient between the resultant glass material and that constituting the reflective mirror section 2 and containing no neodymium becomes too great, so that it becomes difficult to fuse both sections 2 and 3 to each other.

In the above-mentioned embodiment, description has been made of an example coated on the inner surface of the section 2 with the so-called cold mirror film reflecting visible lights and permitting infrared rays to be transmitted therethrough. In the case of a reflective lamp of low power, for example, 60 W, however, it is possible to use a thin film reflecting visible light and not permitting infrared rays to be transmitted therethrough as the thin film coated on the inner surface of the reflective mirror section 2, said thin film being, in other words, a thin film reflecting both visible lights and infrared rays. A deposited film of Al is given as such thin film. In such reflective lamp, the infrared rays reflected from the front lens section 3 are repetitively reflected within the bulb and after all absorbed into the whole of the bulb. In such lamp, however, such infrared rays are also considerably scattered and absorbed into the reflective mirror section 2, so that the temperature of the front lens section 3 does not rise so much. Even in such case, however, for the purpose of causing the largest possible amount of such infrared rays to be ejected outside the bulb and reducing the amount of neodymium employed, the reflective mirror section 2 is required to be formed of glass material containing no neodymium.

Projections are not always required to be provided on the inner surface of the front lens section.

In the above-mentioned embodiment, the respective sufficient thickness of the cold mirror film, EC coating film and deposited film of Al are several tens of microns or so, or preferably in the range of 10 to 30 $\mu$.

As above described, according to the reflective lamp of the invention, the infrared rays contained in the lights emitted from the filament are reflected by the thin film coated on the inner surface of the front lens section and reflecting infrared rays and permitting visible lights to pass therethrough, and are passed through the reflective mirror section and ejected outside, or alternatively are scattered and absorbed into the whole of the bulb. Accordingly, the amount of infrared rays absorbed into the front lens section can be reduced, so that the rise in the temperature of the front lens section can be suppressed to a low level. This can eliminate the inconvenience such as evolution of gases due to the increase in the temperature of the bulb. This makes it possible to obtain a lamp having an elongated life. Since, as above, the rise in the temperature of the front lens section can be suppressed to a low level, we can increase by that extent the amount of neodymium contained in the glass material constituting the front lens section. This enables us to obtain a sufficiently high color rendering. Further, since the infrared rays emitted from the lamp are small in the amount, in the case of illuminating, for example, fresh foods, the freshness of them does not decrease. Further, since, according to the invention, glass material containing no neodymium is used to form the reflective mirror section, the infrared rays emitted from the filament are ejected outside very effectively. This enables us to suppress the rise in the bulb temperature to a low level and also reduce the amount of neodymium for use in the glass material. This enables us to achieve the cost-down of the reflective lamp. Further, our technique of constituting the front lens section by glass material containing neodymium would offer the following advantages.

The thin film 8 being coated on the inner surface of the front lens section is coated therein after this section has been allowed to heat to a high temperature. In this case, since glass material containing neodymium absorbs infrared rays, said heating can be easily carried out with a result that the thin film 8 can be easily formed. In the case of a shield beam type of reflective lamp wherein the front lens section is fused to the reflective mirror section after formation of both sections, this enables us to easily coat the thin film on the inner surface of the front lens section prior to that fusing operation.

What we claim is:

1. A reflective lamp comprising a bulb and a filament contained therein, said bulb including a front lens section and a reflective mirror section fused thereto, said front lens section consisting of glass material containing neodymium in the range of 0.5 to 5.0% by weight as calculated in terms of $Nd_2O_3$ based upon the total weight of glass material and coated on its inner surface with a first thin film reflecting infrared rays and permitting visible light to be transmitted therethrough, said reflective mirror section consisting of neodymium-free glass material and coated on its inner surface with a second thin film reflecting visible light but transmitting infra-red rays therethrough.

2. The reflective lamp according to claim 1 wherein said first thin film is an electric conductive film and said second thin film is a cold mirror film.

3. The reflective lamp according to claim 2 wherein said electric conductive film is a film formed of a halide chosen from the group consisting of a halide of Sn and a halide of In, and of a minute amount of a material chosen from the group consisting of Sb and Sn; and said cold mirror film is a multi-layer interference film which consists of $MgF_2$-Ge-$MgF_2$-$TiO_2$.

4. The reflective lamp according to claim 1 wherein said first thin film is an electric conductive film; and said second thin film is a deposited film of Al.

5. The reflective lamp according to claim 4 wherein said electric conductive film is a film which consists of a halide chosen from the group consisting of Sn and In, which halide contains a minute amount of one metal chosen from the group consisting of Sn and Sb.

6. The reflective lamp according to claim 1 wherein the amount of neodymium in said front lens section is in the range of 1.0 to 2.5% by weight as calculated in terms of $Nd_2O_3$, based upon the total weight of said glass material.

7. The reflective lamp according to claim 3 or 5 wherein a large number of projections for diffusion of light are provided on the inner surface of said front lens section.

* * * * *